US007814677B2

(12) United States Patent
Brewer et al.

(10) Patent No.: US 7,814,677 B2
(45) Date of Patent: Oct. 19, 2010

(54) DRYER EXTENSION AND METHOD OF DRYING AN OBJECT

(76) Inventors: Howard W. Brewer, 751 Prairie Ave., Barrington, IL (US) 60010; James P. Carlstrom, 20760 Deer Lake Dr., Deer Park, IL (US) 60010

( * ) Notice: Subject to any disclaimer, the term of this patent is extended or adjusted under 35 U.S.C. 154(b) by 235 days.

(21) Appl. No.: 11/999,987

(22) Filed: Dec. 7, 2007

(65) Prior Publication Data

US 2009/0145002 A1 Jun. 11, 2009

(51) Int. Cl.
*A45D 20/12* (2006.01)

(52) U.S. Cl. ..... 34/98; 34/96; 34/97; 34/443; 34/283; 34/240; 392/379; 392/380; 392/382; 392/384; 392/385; 132/271

(58) Field of Classification Search ..... 34/443, 34/283, 96, 97, 98, 99, 100, 101, 239, 240, 34/103, 442; 392/379, 380, 382, 384, 385, 392/381; 132/271; 239/548
See application file for complete search history.

(56) References Cited

U.S. PATENT DOCUMENTS

| | | | | |
|---|---|---|---|---|
| 3,609,879 | A | 10/1971 | Hanisco | |
| 3,878,621 | A | 4/1975 | Duerre | |
| 4,094,076 | A * | 6/1978 | Baslow | 34/90 |
| 4,685,222 | A | 8/1987 | Houck, Jr. | |
| 4,857,705 | A | 8/1989 | Blevins | |
| 4,871,900 | A | 10/1989 | Hickman | |
| 4,955,145 | A | 9/1990 | Scivoletto | |
| 4,967,060 | A * | 10/1990 | Lomeli | 392/384 |
| 5,007,182 | A | 4/1991 | Fishman et al. | |
| 5,036,601 | A | 8/1991 | Mulle, Jr. et al. | |
| 5,103,577 | A | 4/1992 | Michaels et al. | |
| 5,148,512 | A | 9/1992 | Owens | |
| 5,157,757 | A | 10/1992 | McDougall | |
| 5,251,066 | A * | 10/1993 | Appelbaum | 359/509 |
| 5,269,071 | A | 12/1993 | Hamabe et al. | |
| D349,585 | S | 8/1994 | Rizzuto, Jr. | |
| 5,377,424 | A | 1/1995 | Albanes | |
| 5,386,644 | A | 2/1995 | Lawall et al. | |
| 5,467,540 | A | 11/1995 | Bastien | |

(Continued)

FOREIGN PATENT DOCUMENTS

GB 2249263 A * 5/1992

*Primary Examiner*—Kenneth B Rinehart
*Assistant Examiner*—Corey Hall
(74) *Attorney, Agent, or Firm*—Meroni & Meroni, P.C.; Charles F. Meroni, Jr.; Christopher J. Scott

(57) ABSTRACT

A dryer extension assembly connects with a hand-held dryer for dispensing heated air beyond an exhaust outlet of the dryer. The extension assembly is constructed from one or more interconnectable tube sections, an adapter section, and a stand section. Each tube section has a plurality of apertures defined through the outer wall and the inner wall for outletting heated air directed through the tube section. The number of interconnectable tube sections essentially enables the user to select an overall length of the extension assembly. The adapter section couples the dryer to a first or top tube section and the stand section receives the last or bottom tube section. The stand section enables the user to stand the extension assembly in a vertical position such that the hand-held dryer is held aloft by the extension assembly.

10 Claims, 3 Drawing Sheets

U.S. PATENT DOCUMENTS 5,592,749 A * 1/1997 Trimmer ..... 34/97
5,598,640 A 2/1997 Schepisi
5,661,910 A 9/1997 Schepsi
5,842,286 A 12/1998 Cantor
5,873,179 A 2/1999 Gregory et al.
5,930,912 A 8/1999 Carder
5,992,761 A * 11/1999 Santa Cruz et al. ..... 239/211
6,038,782 A 3/2000 Schepisi
6,148,539 A 11/2000 Hatfield et al.
6,349,484 B1 2/2002 Cohen
6,401,354 B1 6/2002 Johnson
6,560,779 B1 5/2003 Savage et al.
6,718,650 B2 4/2004 Ross
6,842,581 B2 * 1/2005 Schafer ..... 392/380
2004/0200089 A1 10/2004 Melendrez
2004/0218912 A1 * 11/2004 Shapiro et al. ..... 392/365
2006/0021248 A1 2/2006 Symons

* cited by examiner

DRYER EXTENSION AND METHOD OF DRYING AN OBJECT

BACKGROUND OF THE INVENTION

1. Field of the Invention

The present disclosure relates generally to personal dryers, and in one application, extensions that connect with each other to form an elongated channel to disperse air from the dryer.

2. Description of the Prior Art

Current heaters or dryers for personal use are directed to specific portions of the user's body. For example, hair dryers dry the user's hair. Other dryers, commonly found mounted on bathroom walls, dry the user's hands. Still further, other bulky dryers, commonly found in locker rooms, mount on a structure such as the wall to dry the user's torso. With these locker room dryers, the user uncomfortably manipulates their body in front of the dryer to attempt to dry various body portions beyond the torso. These dryers require more powerful blowers and higher volumetric capability than other dryers such as hair dryers and bathroom dryers. Additionally, these dryers are much more costly requiring permanent installation in the locker room.

Currently, users require a simple device that not only dries the many areas along the entire length of the human body but also is portable, light-weight, free-standing, self-supporting as well as space and cost efficient.

SUMMARY OF THE INVENTION

The present disclosure relates to an extension that connects with the dryer for dispensing air beyond an exhaust outlet of the dryer. The extension comprises a tube section having a first end, a second end and a tube body disposed between the first end and the second end. The tube body has an inner wall and outer wall defining a hollow channel between the first end and the second end. The tube body further has a plurality of apertures defined through the outer wall and the inner wall and in communication with the hollow channel.

The extension further comprises an adapter that connects with the tube section. The adapter has a proximal end, a distal end and an adapter body disposed between the proximal end and the distal end. The proximal end removably connects with the dryer and the distal end connects with the first end of the tube section such that forced air dispelled by the hair dryer flows out the exhaust outlet, within the hollow channel of the tube section and out of the plurality of apertures.

BRIEF DESCRIPTION OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the disclosure by way of example and not by way of limitation. The description clearly enables one skilled in the art to make and use the disclosure, describes several embodiments, adaptations, variations, alternatives, and uses of the disclosure, including what is presently believed to be the best mode of carrying out the invention.

The present disclosure relates to an insertable extension for a personal dryer. The extension can be used in any appropriate personal dryer. However, for purposes of illustrations only, the extension will be described as incorporated into a hair dryer. The term "dryer" does not require any particular geometry and/or configuration.

The extension of the present disclosure preferably comprises or may be preferably constructed from a variety of materials, such as but not limited to, steel, polypropylene, polyethylene or other appropriate thermoplastic material. Further, the extension can have a variety of cross sectional shapes such as elliptical, oval, circular, triangular, square, rectangular or other appropriate configuration. The extension can be of any size to accommodate users of any size.

Figure 1:
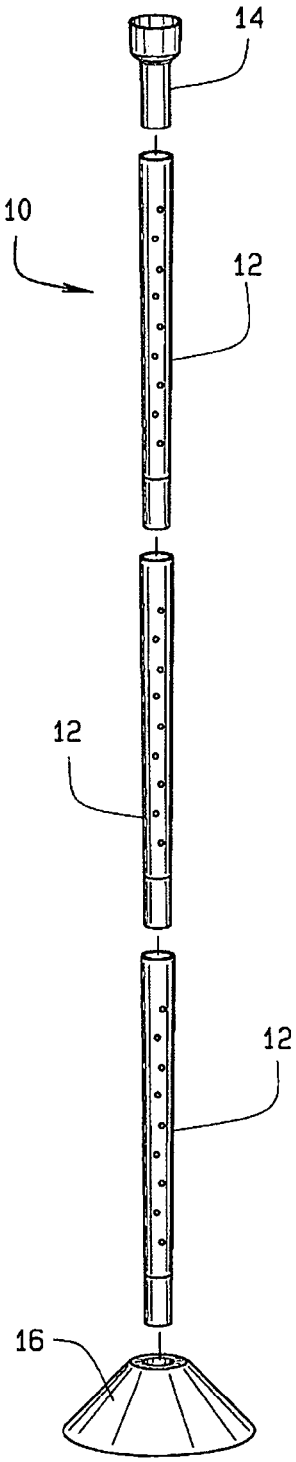
FIG. 1 is an exploded, side elevational view of an extension illustrating tube sections, an adapter and a stand constructed in accordance with and embodying the present disclosure.
Figure 2:
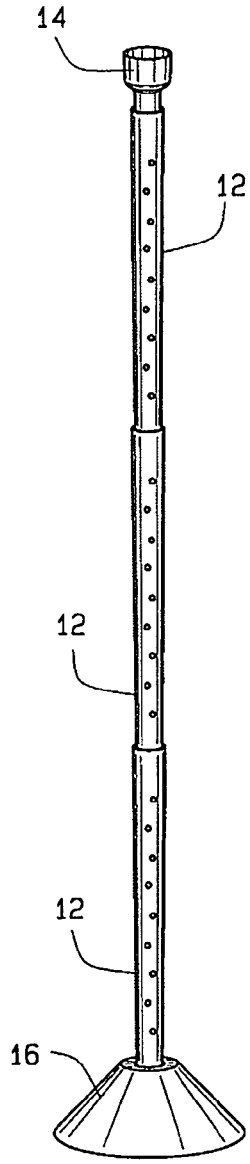
FIG. 2 is a side elevational view of the tube sections, the adapter and stand of FIG. 1 in assembled form.

Referring to the drawings, the extension of the present disclosure, generally shown as 10, comprises a tube section 12, an adaptor 14 and a stand 16 (FIG. 1). Optimally, tube section 12 includes a plurality of tube sections 12. As shown in FIG. 2, the adaptor 14 and tube sections 12 removably connect together and insert into the stand 16. The stand 16 vertically aligns and supports the connected adaptor 14 and tube sections 12 as will be discussed.

Figure 3:
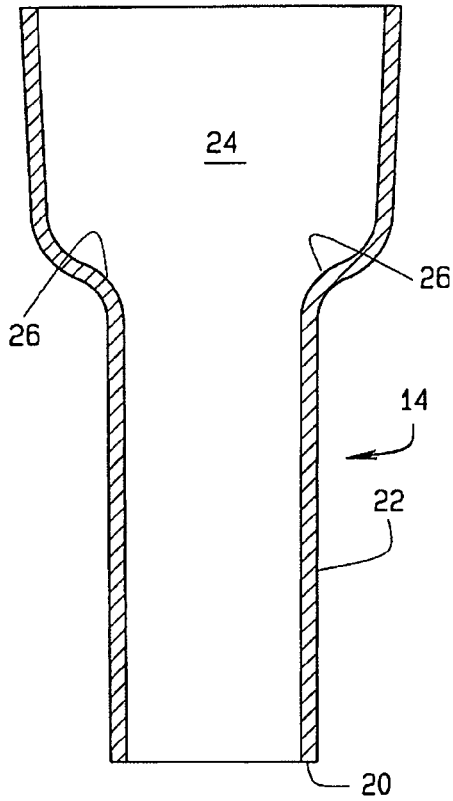
FIG. 3 is a side elevational view of the adapter of FIG. 1.

Turning to FIG. 3, the adaptor 14 has a proximal end 18, a distal end 20 and an adaptor 14 body 22 disposed between the proximal end 18 and the distal end 20. The adaptor 14 body 22 has a predetermined wall thickness. The proximal end 18, the distal end 20 and the adaptor 14 body 22 delimit a hollow adaptor 14 channel 24 disposed therein. Optimally, the proximal end 18 and the distal end 20 are circular shaped wherein the proximal end 18 has a larger diameter than the distal end 20. Accordingly, the adaptor 14 body 22 includes a shoulder 26 to reduce the diameter of the adapter 14 body from the larger proximal end 18 to the smaller distal end 20.

In one aspect of the disclosure, the proximal end 18 has a diameter of about 4¾ inches to about 5¼ inches. In another aspect of the disclosure, the distal end 20 has a diameter from about 2¼ inches to about 2¾ inches. Optimally, the adaptor 14 body 22 has a total length from about 4¼ inches to about 4¾ inches.

At the larger proximal end 18, the adaptor 14 body 22 has a length from about 1 inch to about 1½ inches as measured from the proximal end 18 to the shoulder 26. This portion of the adaptor 14 body 22 between the proximal end 18 and the shoulder 26 matches the diameter of the proximal end 18. The proximal end 18 is sized and shaped to accept an exhaust outlet 28 of a hair dryer 30 (FIG. 6) as will be discussed. The dimensions are representative of an embodiment and are not intended to limit the scope of disclosure. Moreover, any size that is easily used for its intended purpose is acceptable.

Figure 4:
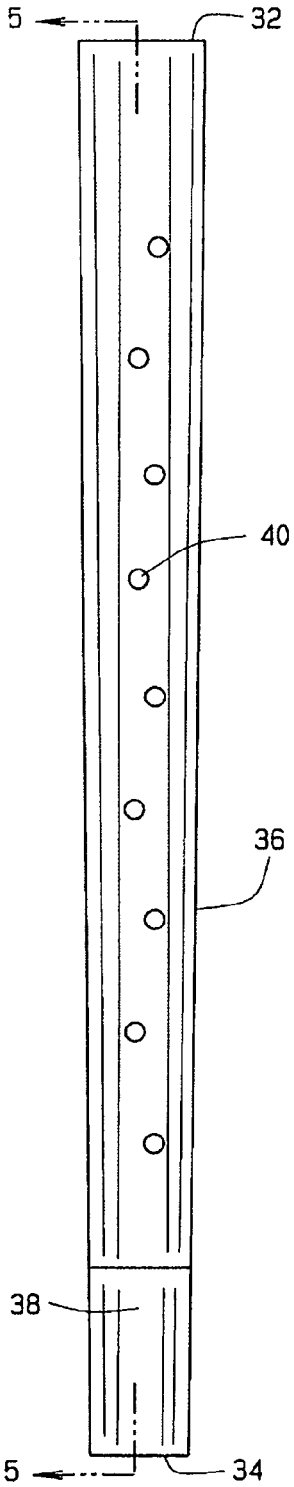
FIG. 4 is a side elevational view of one of the tube sections illustrating a tapered tube body and apertures defined through the tapered the body in accordance with and embodying the present disclosure.

Referring to FIG. 4, the tube sections 12 have a first end 32, second end 34 and a tube body 36 disposed between the first end 32 and the second end 34. Optimally, the first end 32 and the second end 34 are circular shape wherein the first end 32 has a larger diameter than the second end 34. Accordingly, the tube body 36 has a tapered configuration from the first end 32 to the second end 34. Additionally, each second end 34 of the plurality of tube sections 12 has a tapered end configuration 38. As shown, the tube body 36 includes a plurality of apertures 40 defined therethrough. In one aspect, the apertures 40 stagger along the tube body 36. In another embodiment, the apertures 40 stagger in a uniform pattern of two rows along the tube body 36. Optimally, the tube body 36 includes nine apertures 40. However, any number of apertures 40 that is easily used for its intended purposes is acceptable.

Figure 5:
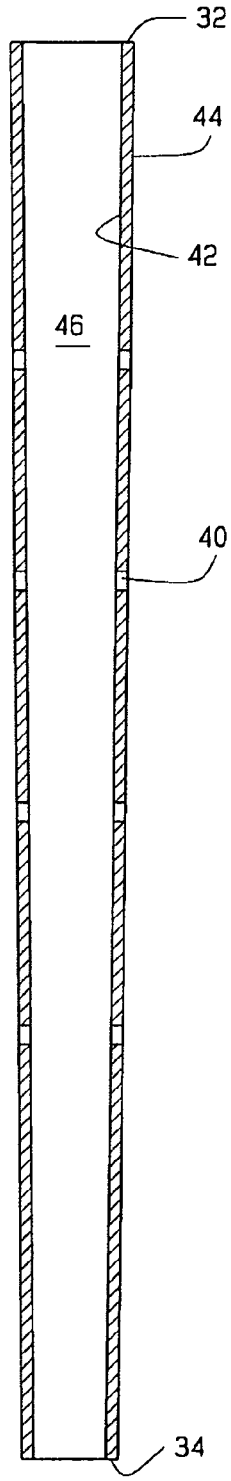
FIG. 5 is a cross sectional view of the tube section as illustrated along line "5-5" of FIG. 4.

The tube body 36 has an inner wall 42 and an outer wall 44 defining a hollow channel 46 between the first end 32 and the second end 34 (FIG. 5). As shown, the plurality of apertures 40 protrudes through the inner wall 42 and the outer wall 44 to communicate with the hollow channel 46.

In one aspect of the disclosure, the tube body 36 has a length of about 18 inches to about 20 inches. Optimally, the tube body 36 has a length of about 19 inches. Further in one aspect, a first aperture 40 is positioned about 2¾ inches along the tube body 36 as measured from the first end 32. Additionally, a second aperture 40 is positioned about 4¼ inches along the tube body 36 as measured from the first end 32. Still further, the apertures 40 of the first row are spaced apart about three inches from each other while the apertures 40 in the second row are spaced apart about three inches from each other. Optimally, each aperture includes a diameter of about one-quarter inches. The dimensions, however, are representative of an embodiment and are not intended to limit the scope of disclosure. Any size of the tube section 12 and its respective apertures 40 are easily used for its intended purposes are acceptable.

Figure 6:
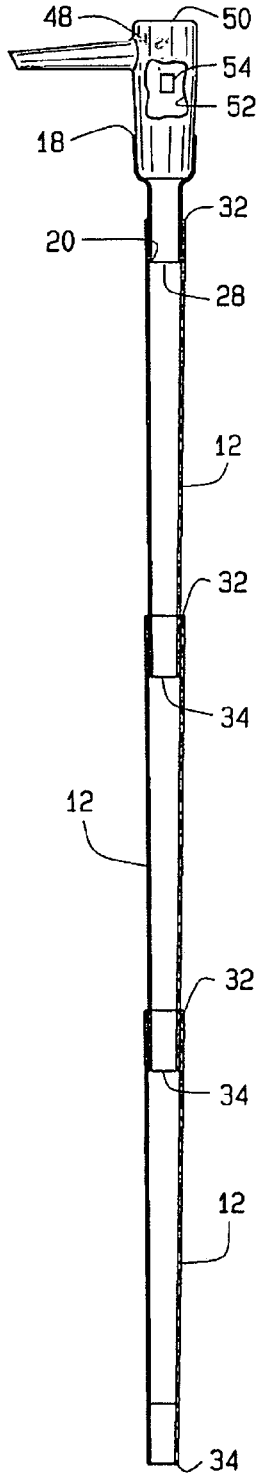
FIG. 6 is a cross sectional view of the tube sections and the adapter in assembled form and connected to a dryer.

As shown in FIG. 6, each tube section 12 of the plurality tube sections 12 has respective first ends 32, second ends 34 and tube bodies 36 disposed therebetween. The size of the diameter of the first end 32, the second end 34 and the tapered configuration of the tube body 36 allow the tube section 12 to removably connect with one another. Optimally, one of the tapered second ends 34 of one of the tube section 12 removably connects with one of the first ends 32 of an adjacent tube section 12 by inserting into the adjacent first end 32. Since the diameter of the second end 34 is smaller than the diameter of the adjacent first end 32, the tapered second end 34 pressurably slides into the first end 32 and into the hollow channel 46. Other tube sections 12 can be telescopically connected in the pattern shown on FIG. 6. The first end 32 and the second end 34 can be construed in any acceptable manner and shape that allows for the connection of the plurality of tube sections 12. The connected tube sections 12 may be easily disassembled by a light pulling force.

As shown in FIG. 6, the hair dryer 30 comprises a housing 48 having an air inlet 50 and the exhaust outlet 28. The housing 48 delimits a chamber 52 between the air inlet 50 and the exhaust outlet 28. The chamber 52 encloses a heater and blower assembly 54 which is in operative communication with the air inlet 50 and the exhaust outlet 28 of the housing 48.

Figure 7:
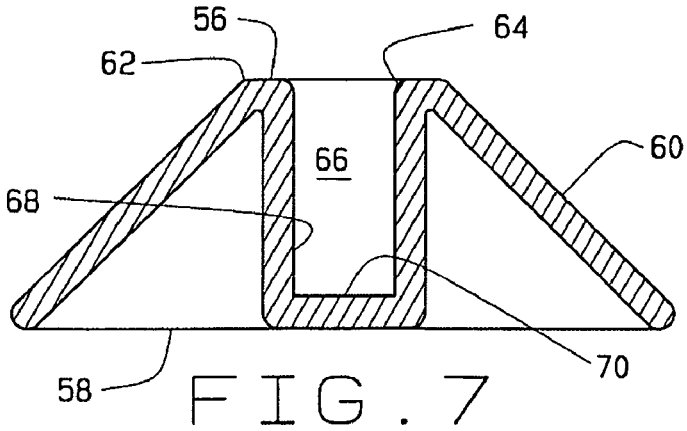
FIG. 7 is cross-sectional view of the stand of FIG. 1.

The stand 16 has a top 56, a bottom 58 and a sidewall 60 connecting the top 56 and the bottom 58 (FIG. 7). In one embodiment, the top 56 and the bottom 58 are circular shape wherein the top 56 has a smaller diameter than the bottom 58. Accordingly, the sidewall 60 slopes or tapers as the sidewall 60 connects the top 56 and the bottom 58. Optimally, the sidewall 60 has a conical shape. The stand 16 can have a variety of cross sectional shapes such as elliptical, oval, circular, triangular, square, rectangular or other appropriate configuration.

The top 56 includes an outer portion 62 and an inner portion 64 wherein the inner portion 64 defines a slot 66 extending downward toward the bottom 58. The slot 66 includes opposing internal walls 68 that extend to a base 70 which is positioned above the bottom 58. The slot 66 is sized and shaped to accept the tapered second end 34 of the lowermost tube section 12 of the connected tube sections 12 (FIG. 6).

In one aspect of the disclosure, the stand 16 has a height, as measured between the top 56 and the bottom 58, from about two and a half inches to about three and half inches. Optimally, the stand 16 has a height of about three inches. The slot 66 has a height from about two and a quarter inches to about two and three quarter inches. Optimally, the slot 66 has a height of about two and half inches. Additionally, the slot 66 has a width of about two and one quarter inches to about two and three quarter inches. The dimensions are representative of an embodiment and are not intended to limit the scope of the disclosure. Any size that is easily used for its intended purpose is acceptable.

The slot 66 has a width slightly larger than the diameter of the second of the lowermost connected tube sections 12 such that the second end 34 pressurably slides or inserts within the slot 66. When inserted into the slot 66, the second end 34 contacts the base 70 of the slot 66. The internal walls 68 and the base 70 of the slot 66 stabilize and support the inserted second end 34 and the now vertically aligned connected tube sections 12. The slot 66 provides rigidity and stabilization to the vertically aligned and connected tube sections 12. Any supporting member that can be employed to support/stabilize the connected tube section 12 is intended to be within the scope of the disclosure.

Figure 8:
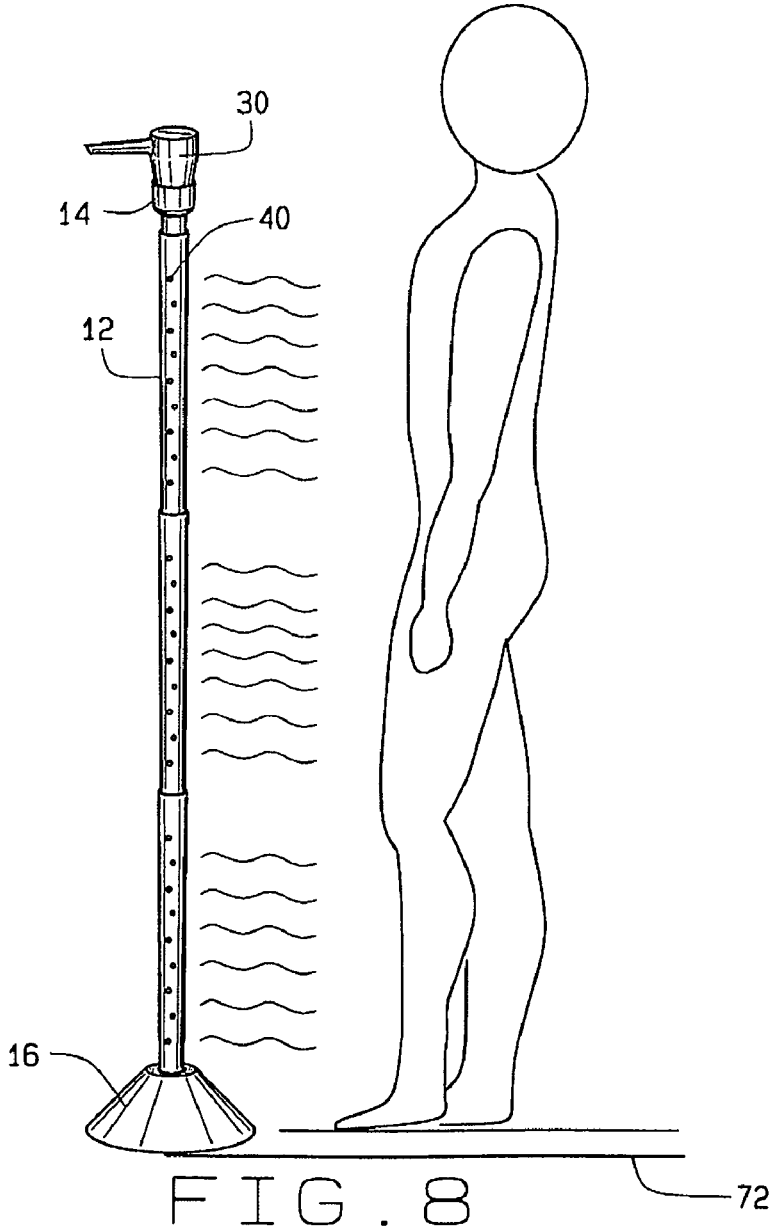
FIG. 8 is a side elevational view of the extension connected to the dryer wherein the extension is dispersing air from the dryer and onto the user.

Turning to FIGS. 1 and 8 and referring to FIGS. 2-7, during one mode of operation, the users places the stand 16 on the floor 72. The user removably connects together the plurality of tube sections 12 by inserting the second end 34 of one of the tube sections 12 into the first end 32 of another tube section 12. The user then inserts the lowermost second end 34 of the connected tube sections 12 into the slot 66 to vertically align the connected tube sections 12. The user also inserts the adapter 14 into the uppermost first end 32 of the connected tube sections 12. In particular, the distal end 20 of the adapter 14 inserts within the first end 32 of the uppermost connected tube section 12.

With the stabilized and vertically aligned tube sections 12 and adapter 14, the user inserts the exhaust outlet 28 of the hair dryer 30 into the proximal end 18 of the adapter 14. The exhaust outlet 28 inserts into the proximal end 18 and rests upon the shoulders 26 of the adapter 14. When activated, the heater and blower assembly 54 of the hair dryer 30 discharges forced air out of the exhaust outlet 28, through the adaptor 14 channel 24 and within the hollow channels 46 of the connected tube sections 12. The air flows through the apertures 40 of the connected tube sections 12 and onto the object such as the user's body. The configuration of the connected tube sections 12 and the apertures 40 directs the forced air along the entire length or substantially the entire length of the user's body. The forced air may be heated by the dryer 30.

The extension 10 of the present disclosure utilizes the equivalent heating element and fan/blower assembly of a common hand-held hair dryer to accomplish drying substantially to the entire length of the human body. In so doing, the extension 10 is configured for varied placement, easily assembled or disassembled, self-supporting and is easily transportable by any adult person without the need for assistance or tools. Thus, the extension 10 is portable, lightweight, free-standing, self-supporting as well as space and cost efficient. In addition, the extension 10 and the heating blower assembly when assembled work together to enable a person to be dried in a hands free manner without touching the dryer for the extension serves to provide the sole means of support for the blower assembly when it is mounted in an elevated position in supported relation on the adaptor which is carried at upper end of upright extension. The adapter acts as a dryer holder to securely mount the hand held dryer in assembled relation therewith. The extension can be knock-down by disengaging the ends of the tube sections from the other end from the base and easily stored in a relatively small area in a bathroom closet or in a box with the dryer removed from the adaptor for ready use to perform other uses such as solely for hair drying purposes in a conventional manner. Thus, the user does not need to purchase an extension with a built in dryer to save manufacturing costs.

In view of the above, it will be seen that the several objects of the disclosure are achieved and other advantageous results are obtained. As various changes could be made in the above constructions without departing from the scope of the disclosure, it is intended that all matter contained in the above description or shown in the accompanying drawings shall be interpreted as illustrative and not in a limiting sense.

Moreover, the use of the terms "upper" and "lower" or "top" or "bottom" and variations of these terms is made for convenience, but does not require any particular orientation of the components.

I claim:

1. An extension that connects with a portable hair dryer for dispensing air beyond an exhaust outlet of the portable hair dryer, the extension comprising:

a tapered tube section having a planar, circular, open first tube end, a planar, circular, open second tube end, and a tapered tube body disposed between the first tube end and the second tube end, the tapered tube body having an inner wall and outer wall defining a hollow channel between the first tube end and the second tube end, the tapered tube body further having a plurality of apertures defined through the outer wall and the inner wall and in communication with the hollow channel, the tapered tube body having a uniform body slope angled toward the second tube end;

a frustoconical stand having a planar, circular, open top portion, a planar, circular, open bottom portion, a frustoconical sidewall connecting the top and bottom portions, and a cylindrical tube-receiving sleeve extending orthogonally intermediate the top and bottom portions, the tube-receiving sleeve being sized to vertically accept the second tube end, the frustoconical sidewall having a uniform stand slope angled toward the top portion; and an adapter connected to the tapered tube section, the adapter having a planar, circular, open proximal end, a planar, circular, open distal end, and an adapter body disposed between the proximal and distal ends, the adapter body comprising a shouldered portion for shoulder-reducing the diameter of the adapter body intermediate the proximal and distal ends wherein the proximal end removably receives the exhaust outlet such that the shouldered portion provides stop structure for the exhaust outlet, the distal end being received within the first tube end such that forced air dispelled by the portable hair dryer flows out the distal end, within the hollow channel of the tube section, and out of the plurality of apertures.

2. The extension of claim 1 further wherein the tube-receiving sleeve is sized to vertically accept the second tube end for axially aligning the connected adapter and the tapered tube section so as to position the connected tapered tube section and adaptor such that the heated forced air dispelled by the portable hair dryer flows axially out the distal end, within the channel, and radially out of the plurality of apertures.

3. The extension of claim 1 wherein the plurality of apertures are staggered along the tube body.

4. The extension of claim 1 wherein the plurality of apertures are staggered in a uniform pattern along the tube body.

5. The extension of claim 1 wherein the adapter removably connects with the first tube end.

6. The extension of claim 1 wherein the adapter fixedly connects with the first tube end.

7. The extension of claim 1 wherein the tapered tube section includes a plurality of tapered tube sections such that each tube section respectively has a first tube end, a second tube end, and a tapered tube body disposed therebetween.

8. The extension of claim 7 wherein the first tube ends each comprise a tapered inner diameter and the second tube ends each comprise a tapered outer diameter, the tapered outer diameters of the second tube ends being receivable by the tapered inner diameter of the first tube ends for removably interconnecting adjacent tube sections such that adjacent tube sections can be readily engaged and disengaged in knock-down relation for ease of storage.

9. An object drying method, the method comprising the steps of:

removably connecting together a plurality of tapered tube sections, each tube section having a first tube end, a second tube end, and a tapered tube body disposed therebetween, each tapered tube body having a plurality of apertures defined there through;

inserting a lowermost second tube end into a cylindrical, tube-receiving sleeve of a frustoconical stand to vertically support the connected tapered tube sections;

connecting an adapter to an uppermost first tube end of the connected tube sections;

connecting an exhaust outlet of a portable hair dryer to the adapter; and discharging heated air axially through the exhaust outlet, within the tube section, and radially out through the apertures and onto an object for drying the object.

10. The method of claim 9 further comprising extending the tapered tube section by connecting another tapered tube section to the tapered tube section connected to the adapter.

* * * * *